US011371180B2

(12) United States Patent
Carpenter et al.

(10) Patent No.: US 11,371,180 B2
(45) Date of Patent: Jun. 28, 2022

(54) LAUNDRY TREATING APPLIANCE HAVING A SPRAY ARM ASSEMBLY

(71) Applicant: WHIRLPOOL CORPORATION, Benton Harbor, MI (US)

(72) Inventors: Scott E. Carpenter, Wanatah, IN (US); Paul M. Dunn, Paw Paw, MI (US); Marcus R. Fischer, Stevensville, MI (US); Gregory R. Fulmer, St. Joseph, MI (US); Joel M. Sells, Watervliet, MI (US); Thomas D. Spicer, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 164 days.

(21) Appl. No.: 16/694,101

(22) Filed: Nov. 25, 2019

(65) Prior Publication Data

US 2020/0181828 A1 Jun. 11, 2020

Related U.S. Application Data

(60) Provisional application No. 62/776,245, filed on Dec. 6, 2018.

(51) Int. Cl.

| | |
|---|---|
| ***D06F 39/08*** | (2006.01) |
| ***D06F 29/00*** | (2006.01) |
| ***D06F 39/14*** | (2006.01) |

(52) U.S. Cl.

CPC ..... *D06F 39/088* (2013.01); *D06F 29/00* (2013.01); *D06F 39/14* (2013.01)

(58) Field of Classification Search

None

See application file for complete search history.

(56) References Cited

U.S. PATENT DOCUMENTS

| | | | |
|---|---|---|---|
| 6,152,160 | A | 11/2000 | Bowden Wilcox et al. |
| 6,611,972 | B2 | 9/2003 | Underbink et al. |
| 6,869,204 | B2 | 3/2005 | Morgan et al. |
| 6,886,371 | B2 | 5/2005 | Arai et al. |
| 7,159,252 | B2 | 1/2007 | Underbrink et al. |
| 7,296,443 | B2 | 11/2007 | Usherovich et al. |
| 7,313,932 | B2 | 1/2008 | Ryohke et al. |
| 7,377,661 | B2 | 5/2008 | Douglass |
| 7,513,132 | B2 | 4/2009 | Wright et al. |
| 7,617,702 | B2 | 11/2009 | Sunshine et al. |
| 7,735,345 | B2 | 6/2010 | Wright et al. |
| 8,985,886 | B1 | 3/2015 | Derrick |
| 9,200,399 | B2 | 12/2015 | Kim et al. |
| 9,217,215 | B2 | 12/2015 | Kim et al. |

(Continued)

FOREIGN PATENT DOCUMENTS

| | | | |
|---|---|---|---|
| CN | 202708255 | U | 1/2013 |
| CN | 105483982 | A | 4/2016 |

(Continued)

*Primary Examiner* — Cristi J Tate-Sims

(74) *Attorney, Agent, or Firm* — McGarry Bair PC

(57) ABSTRACT

A laundry treating appliance includes a chassis defining an interior. A rotatable treating chamber is located within the interior and has an access opening. A cover is movably mounted to the chassis for selective movement between opened and closed positions to open and close the access opening. The laundry treating appliance further comprises a spray arm assembly having a spray head.

19 Claims, 9 Drawing Sheets

(56) References Cited

U.S. PATENT DOCUMENTS

| | | | | |
|---|---|---|---|---|
| 9,315,934 | B2 | 4/2016 | Kim et al. | |
| 9,611,578 | B2 | 4/2017 | Underly et al. | |
| 2004/0168481 | A1 | 9/2004 | Usherovich et al. | |
| 2015/0247276 | A1 | 9/2015 | Kim et al. | |
| 2015/0275412 | A1 | 10/2015 | Kim et al. | |
| 2016/0326685 | A1 | 11/2016 | Pollett | |
| 2017/0037559 | A1 | 2/2017 | Gallagher et al. | |
| 2018/0340288 | A1* | 11/2018 | Kim | D06F 39/12 |
| 2019/0071815 | A1* | 3/2019 | Woodham, Jr. | D06F 39/14 |
| 2019/0242052 | A1* | 8/2019 | Bensel | D06F 29/00 |
| 2019/0276976 | A1* | 9/2019 | Leibman | D06F 33/34 |
| 2019/0352836 | A1* | 11/2019 | Boutiette | D06F 39/088 |

FOREIGN PATENT DOCUMENTS

| | | | |
|---|---|---|---|
| DE | 3429117 | A1 | 6/1986 |
| EP | 1930493 | A1 | 6/2008 |
| ES | 2258892 | A1 | 9/2006 |
| KR | 200154561 | Y1 | 8/1999 |
| WO | 2017039185 | A1 | 3/2017 |

* cited by examiner

LAUNDRY TREATING APPLIANCE HAVING A SPRAY ARM ASSEMBLY

CROSS-REFERENCE TO RELATED APPLICATIONS

This application claims the benefit of U.S. Provisional Patent Application No. 62/776,245, filed on Dec. 6, 2018, which is incorporated herein by reference in its entirety.

BACKGROUND

Laundry treating appliances, such as washing machines, refreshers, and non-aqueous systems, can have a configuration based on a rotating container that at least partially defines a treating chamber in which laundry items are placed for treating. The laundry treating appliance can have a controller that implements a number of user-selectable, pre-programmed cycles of operation. Hot water, cold water, or a mixture thereof along with various treating chemistries, or detergents, can be supplied to the treating chamber in accordance with the cycle of operation.

Laundry treating appliances typically operate to treat laundry items by placing the laundry items in contact with treating fluid such as a detergent/water mixture, sometimes referred to as wash liquor, and providing relative motion between the laundry items and the fluid. Commonly, a fabric mover, such as an agitator, provides mechanical energy to a load of laundry items immersed in the cleaning fluid by agitating the laundry load in a manner that both jostles the laundry items in the fluid and circulates the fluid through the laundry items. A laundry treating appliance for home use can perform a select programmed series of operations on fabric placed in a basket or drum located within the interior of the machine. However, it can occur that none of a selection of preprogrammed wash cycles is thought by the washing machine user to be sufficient to fully remove certain stains on the fabric being laundered. The user can choose to address such stains manually before adding the stained laundry items to the laundry load.

BRIEF SUMMARY

In one aspect, the present disclosure relates to a laundry treating appliance comprising a chassis defining an interior, a rotatable treating chamber located within the interior and having an access opening, a cover movably mounted to the chassis for selective movement between opened and closed positions to open and close the access opening, and a spray arm assembly having a spray head and a faucet, with the spray head overlying the access opening when the cover is closed to spray liquid into the treating chamber, and the faucet operable to emit liquid into the treating chamber when the cover is opened.

In another aspect, the present disclosure relates to a laundry treating appliance comprising a chassis defining an interior, a rotatable treating chamber located within the interior and having an access opening, a spray arm assembly having a spray head including a scrub surface, the spray arm assembly movable through a range of motion between a first position and a second position, and a basin underlying the spray head throughout the range of motion and having a drain fluidly coupled with the treating chamber.

DETAILED DESCRIPTION OF THE DISCLOSURE

Figure 1:
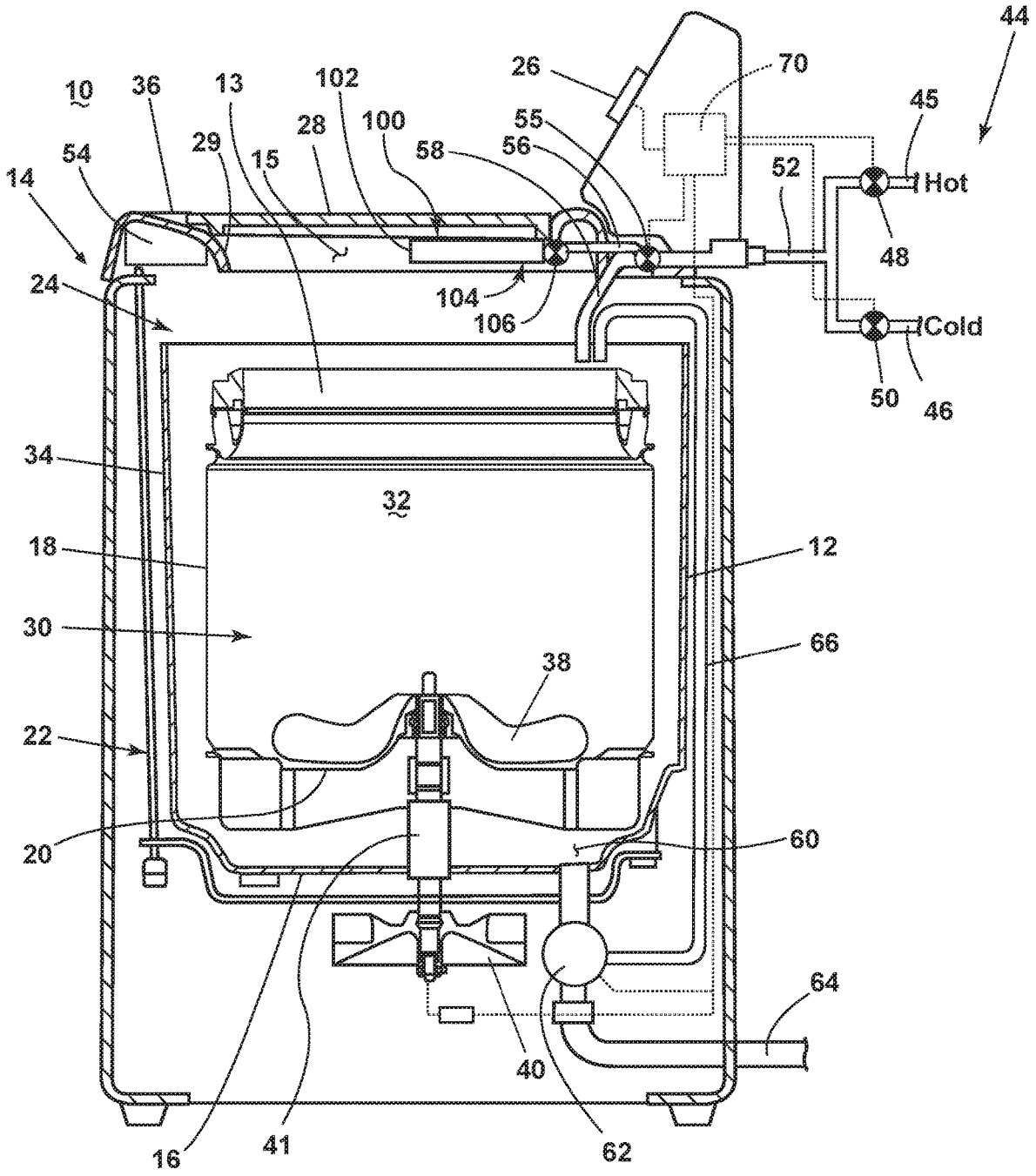
FIG. 1 is a schematic cross-sectional view of a laundry treating appliance in the form of a washing machine including a spray arm assembly.

FIG. 1 is a schematic view of a laundry treating appliance according to aspects of the present disclosure. The laundry treating appliance can be any appliance which performs a cycle of operation to clean or otherwise treat items placed therein, non-limiting examples of which include a horizontal or vertical axis clothes washer; a clothes dryer; a combination washing machine and dryer; a dispensing dryer; a tumbling or stationary refreshing/revitalizing machine; an extractor; a non-aqueous washing apparatus; and a revitalizing machine. While the laundry treating appliance of FIG. 1 is illustrated as a vertical axis, top-load laundry treating appliance, the aspects of the present disclosure can have applicability in laundry treating appliances with other configurations.

Washing machines are typically categorized as either a vertical axis washing machine or a horizontal axis washing machine. As used herein, the term "horizontal axis" washing machine refers to a washing machine having a rotatable drum that rotates about a generally horizontal axis relative to a surface that supports the washing machine. The drum can rotate about the axis inclined relative to the horizontal axis, with fifteen degrees of inclination being one example of the inclination. Similar to the horizontal axis washing machine, the term "vertical axis" washing machine refers to a washing machine having a rotatable drum that rotates about a generally vertical axis relative to a surface that supports the washing machine. However, the rotational axis need not be perfectly vertical to the surface. The drum can rotate about an axis inclined relative to the vertical axis, with fifteen degrees of inclination being one example of the inclination.

In another aspect, the terms vertical axis and horizontal axis are often used as shorthand terms for the manner in which the appliance imparts mechanical energy to the laundry, even when the relevant rotational axis is not absolutely vertical or horizontal. As used herein, the "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through wash liquid in the drum. The clothes mover can typically be moved in a reciprocating rotational movement. In some vertical axis washing machines, the drum rotates about a vertical axis generally perpendicular to a surface that supports the washing machine. However, the rotational axis need not be vertical. The drum may rotate about an axis inclined relative to the vertical axis.

As used herein, the "horizontal axis" washing machine refers to a washing machine having a rotatable drum, perforated or imperforate, that holds laundry items and washes the laundry items. In some horizontal axis washing machines, the drum rotates about a horizontal axis generally parallel to a surface that supports the washing machine. However, the rotational axis need not be horizontal. The drum can rotate about an axis inclined or declined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a washing machine can be top-loading or front-loading. In a top-loading washing machine, laundry items are placed into the drum through an access opening in the top of a cabinet, while in a front-loading washing machine laundry items are placed into the drum through an access opening in the front of a cabinet. If a washing machine is a top-loading horizontal axis washing machine or a front-loading vertical axis washing machine, an additional access opening is located on the drum.

The laundry treating appliance of FIG. 1 is illustrated as a vertical-axis washing machine 10, which can include a structural support system including a cabinet 14, which defines a housing within which a laundry holding system resides. The cabinet 14 can be a housing having a chassis and/or a frame, to which decorative panels can or cannot be mounted, defining an interior enclosing components typically found in a conventional washing machine, such as motors, pumps, fluid lines, controls, sensors, transducers, and the like. Such components will not be described further herein except as necessary for a complete understanding of the present disclosure.

The laundry holding system of the illustrated exemplary washing machine 10 can include a rotatable basket 30 having an open top 13 that can be disposed within the interior of the cabinet 14 and can define a rotatable treating chamber 32 for receiving laundry items for treatment and an access opening 15. The basket 30 is configured to receive a laundry load comprising articles for treatment, including, but not limited to, a hat, a scarf, a glove, a sweater, a blouse, a shirt, a pair of shorts, a dress, a sock, and a pair of pants, a shoe, an undergarment, and a jacket. The open top can be aligned with the access opening 15. A tub 34 can also be positioned within the cabinet 14 and can define an interior 24 within which the basket 30 can be positioned. The tub 34 can have a generally cylindrical side or tub peripheral wall 12 closed at its bottom end by a base 16 that can at least partially define a sump 60.

The basket 30 can have a generally peripheral side wall 18, which is illustrated as a cylindrical side wall, closed at the basket end by a basket base 20 to at least partially define the treating chamber 32. The basket 30 can be rotatably mounted within the tub 34 for rotation about a vertical basket axis of rotation and can include a plurality of perforations, such that liquid can flow between the tub 34 and the rotatable basket 30 through the perforations. While the illustrated washing machine 10 includes both the tub 34 and the basket 30, with the basket 30 defining the treating chamber 32, it is within the scope of the present disclosure for the laundry treating appliance to include only one receptacle, with the receptacle defining the laundry treatment chamber for receiving the load to be treated.

The cabinet 14 can further define a top wall 36, which can comprise a shroud 29 or to which the shroud 29 can be coupled. The shroud 29 can define at least a portion of the access opening 15, such that the shroud 29 can at least partially encircle the access opening 15. The shroud 29 can curve downwards toward the treating chamber 32 to direct laundry items into the basket 30. The shroud 29 can overlie a portion of the basket 30 such that the laundry items do not fall between the basket 30 and the tub 34. A selectively openable cover, illustrated herein as comprising a lid 28 can be movably mounted to the cabinet 14 for selective movement between an opened position and a closed position to selectively open and close the access opening 15, respectively, and to provide access into the laundry treating chamber 32 through the access opening 15 of the basket 30.

A laundry mover 38 can be rotatably mounted within the basket 30 to impart mechanical agitation to a load of laundry placed in the basket 30. The laundry mover 38 can be oscillated or rotated about its vertical axis of rotation during a cycle of operation in order to produce load motion effective to wash the load contained within the treating chamber 32. Other exemplary types of laundry movers include, but are not limited to, an agitator, a wobble plate, and a hybrid impeller/agitator.

The basket 30 and the laundry mover 38 can be driven by a drive system 40 that includes a motor 41, which can include a gear case, operably coupled with the basket 30 and laundry mover 38. The motor 41 can rotate the basket 30 at various speeds in either rotational direction about the vertical axis of rotation, including at a spin speed wherein a centrifugal force at the inner surface of the basket side wall 18 is 1 g or greater. Spin speeds are commonly known for use in extracting liquid from the laundry items in the basket 30, such as after a wash or rinse step in a treating cycle of operation. A loss motion device or clutch (not shown) can be included in the drive system 40 and can selectively operably couple the motor 41 with either the basket 30 and/or the laundry mover 38.

A suspension system 22 can dynamically hold the tub 34 within the cabinet 14. The suspension system 22 can dissipate a determined degree of vibratory energy generated by the rotation of the basket 30 and/or the laundry mover 38 during a treating cycle of operation. Together, the tub 34, the basket 30, and any contents of the basket 30, such as liquid and laundry items, define a suspended mass for the suspension system 22.

A liquid supply system can be included to provide liquid, such as water or a combination of water and one or more wash aids, such as detergent, into the treating chamber 32. The liquid supply system can include a water supply 44 configured to supply hot or cold water. The water supply 44 can include a hot water inlet 45 and a cold water inlet 46. A valve assembly can include a hot water valve 48, a cold water valve 50, and a diverter valve 55, and various conduits 52, 56, 58 for selectively distributing the water supply 44 from the hot water and cold water inlets 45, 46. The valves 48, 50 are selectively openable to provide water, such as from a household water supply (not shown) to the conduit 52. The valves 48, 50 can be opened individually or together to provide a mix of hot and cold water at a selected temperature. While the valves 48, 50 and conduit 52 are illustrated exteriorly of the cabinet 14, it will be understood that these components can be internal to the cabinet 14.

The liquid supply system can further comprise a spray arm assembly 100, the spray arm assembly 100 comprising a spray head 102 and a faucet 104. As illustrated, the spray arm assembly 100 can be fluidly coupled with the conduit 52 through a diverter valve 55 and a first water conduit 56. A spray arm valve 106 can control the flow of liquid to the spray head 102 and the faucet 104, for example by selectively fluidly coupling either the spray head 102 or the faucet 104 with the first water conduit 56. The spray arm assembly 100 can include means for supplying or mixing detergent to or with water from the first water conduit 56. Alternatively, water from the first water conduit 56 can also be supplied to the tub 34 through the spray arm assembly 100 without the addition of a detergent. A second water conduit, illustrated as the water inlet 58, can also be fluidly coupled with the conduit 52 through the diverter valve 55 such that water can be supplied directly to the treating chamber through the open top of the basket 30. Either or both of the spray arm assembly 100 or the water inlet 58 can be configured to dispense treating chemistry or water into the tub 34 in a desired pattern and under a desired amount of pressure. For example, either or both of the spray arm assembly 100 or the water inlet 58 can be configured to dispense a flow or stream of treating chemistry or water into the tub 34 by gravity, i.e. a non-pressurized stream.

A treating chemistry dispenser 54 can be provided for dispensing treating chemistry to the basket 30, either directly or mixed with water from the water supply 44. The treating chemistry dispenser 54 can be a single use dispenser, a bulk dispenser, or a combination of a single use and bulk dispenser in non-limiting examples, and is fluidly coupled to the treating chamber 32. While the treating chemistry dispenser 54 is illustrated herein as being provided at the top wall 36 or the shroud 29, it will be understood that other locations for the treating chemistry dispenser 54 can be contemplated, such as at a different location within the cabinet 14. Further, the treating chemistry dispenser 54 can be provided in a drawer configuration or as at least one reservoir fluidly coupled to the treating chamber 32.

The treating chemistry dispenser 54 can include means for supplying or mixing detergent to or with water from the water supply 44. Alternatively, water from the water supply 44 can also be supplied to the tub 34 through the treating chemistry dispenser 54 without the addition of a detergent. The treating chemistry dispenser 54 can be configured to dispense the treating chemistry or water into the tub 34 in a desired pattern and under a desired amount of pressure. For example, the treating chemistry dispenser 54 can be configured to dispense a flow or stream of treating chemistry or water into the tub 34 by gravity, i.e. a non-pressurized stream.

The treating chemistry dispenser 54 can include multiple chambers or reservoirs fluidly coupled to the treating chamber 32 for receiving doses of different treating chemistries. The treating chemistry dispenser 54 can be implemented as a dispensing drawer that is slidably received within the cabinet 14, or within a separate dispenser housing which can be provided in the cabinet 14. The treating chemistry dispenser 54 can be moveable between a fill position, where the treating chemistry dispenser 54 is exterior to the cabinet 14 and can be filled with treating chemistry, and a dispense position, where the treating chemistry dispenser 54 is interior of the cabinet 14.

Non-limiting examples of treating chemistries that can be dispensed by the dispensing system during a cycle of operation include one or more of the following: water, detergents, surfactants, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof. The treating chemistries can be in the form of a liquid, powder, or any other suitable phase or state of matter.

Additionally, the liquid supply system and treating chemistry dispenser 54 can differ from the configuration shown, such as by inclusion of other valves, conduits, wash aid dispensers, heaters, sensors, such as water level sensors and temperature sensors, and the like, to control the flow of treating liquid through the washing machine 10 and for the introduction of more than one type of detergent/wash aid.

A liquid recirculation system can be provided for recirculating liquid from the tub 34 into the treating chamber 32. More specifically, the sump 60 can be located in the bottom of the tub 34 and the liquid recirculation system can be configured to recirculate treating liquid from the sump 60 onto the top of a laundry load located in the treating chamber 32. A pump 62 can be housed below the tub 34 and can have an inlet fluidly coupled with the sump 60 and an outlet configured to fluidly couple to either or both a household drain 64 or a recirculation conduit 66. In this configuration, the pump 62 can be used to drain or recirculate wash water in the sump 60. As illustrated, the recirculation conduit 66 can be fluidly coupled with the treating chamber 32 such that it supplies liquid into the open top of the basket 30. The liquid recirculation system can include other types of recirculation systems.

It is noted that the illustrated drive system, suspension system, liquid supply system, recirculation and drain system are shown for exemplary purposes only and are not limited to the systems shown in the drawings and described above. For example, the liquid supply, recirculation and pump systems can differ from the configuration shown in FIG. 1, such as by inclusion of other valves, conduits, sensors (such as liquid level sensors and temperature sensors), and the like, to control the flow of liquid through the washing machine 10 and for the introduction of more than one type of treating chemistry. For example, the liquid supply system can be configured to supply liquid into the interior of the tub 34 not occupied by the basket 30 such that liquid can be supplied directly to the tub 34 without having to travel through the basket 30. In another example, the liquid supply system can include a single valve for controlling the flow of water from the household water source. In another example, the recirculation and pump system can include two separate pumps for recirculation and draining, instead of the single pump as previously described.

The washing machine 10 can also be provided with a heating system (not shown) to heat liquid provided to the treating chamber 32. In one example, the heating system can include a heating element provided in the sump to heat liquid that collects in the sump 60. Alternatively, the heating system can be in the form of an in-line heater that heats the liquid as it flows through the liquid supply, dispensing and/or recirculation systems.

The washing machine 10 can further include a control system, illustrated herein as a controller 70, coupled with various working components of the washing machine 10 to control the operation of the working components and to implement one or more treating cycles of operation. A user interface 26 can be operably coupled with the controller 70. The user interface 26 can provide an input and output function for the controller 70. The user interface 26 can include one or more knobs, dials, switches, displays, touch screens and the like for communicating with the user, such as to receive input and provide output. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the washing machine 10 and can allow the controller 70 to communicate with the user in a variety of ways. For example, the controller 70 can be configured to send a text message to the user, send an electronic mail to the user, or provide audio information to the user either through the washing machine 10 or utilizing another device such as a mobile phone.

The controller 70 can include the machine controller and any additional controllers provided for controlling any of the components of the washing machine 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the washing machine 10.

Figure 2:
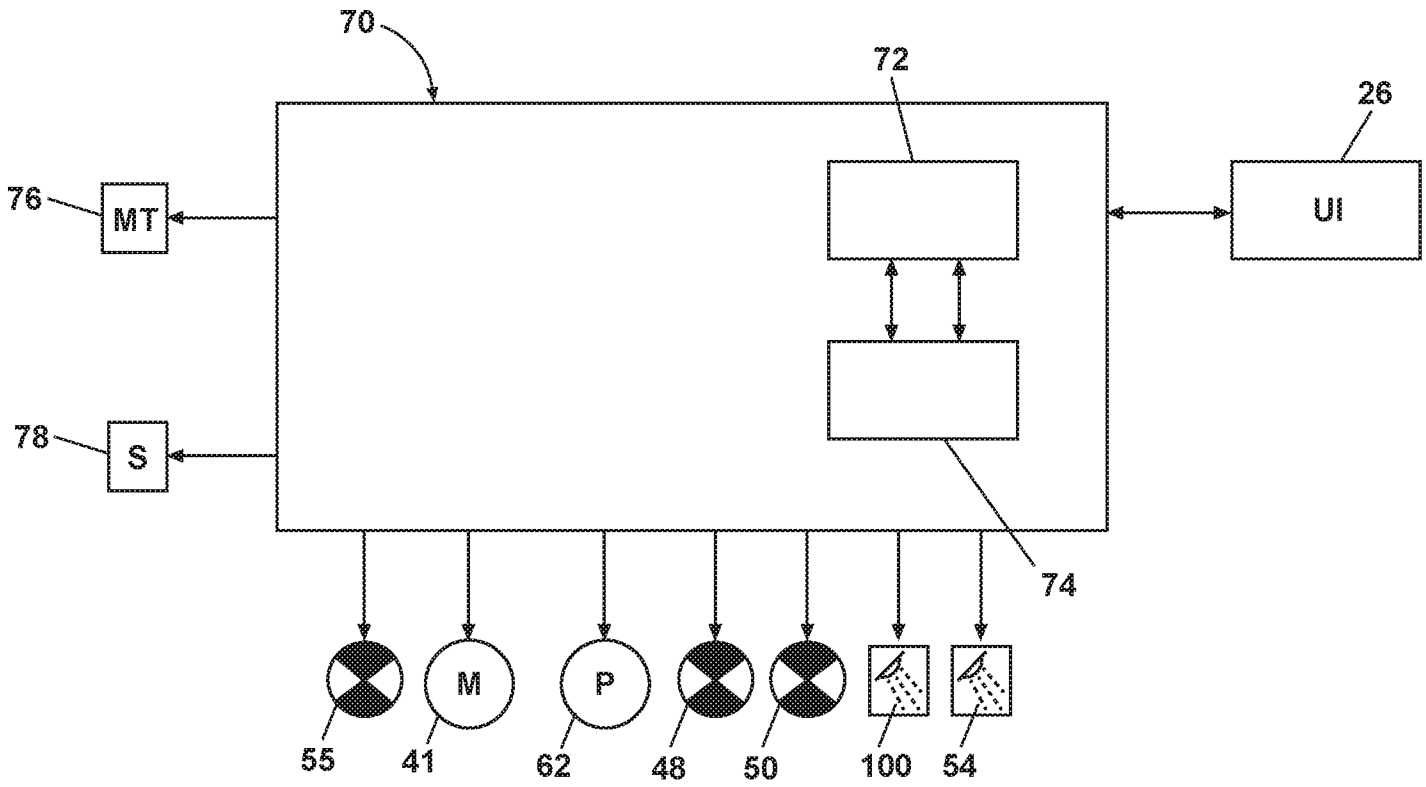
FIG. 2 is a schematic representation of a control system for controlling the operation of the laundry treating appliance of FIG. 1.

As illustrated in FIG. 2, the controller 70 can be provided with a memory 72 and a central processing unit (CPU) 74. The memory 72 can be used for storing the control software that can be executed by the CPU 74 in completing a cycle of operation using the washing machine 10 and any additional software. For example, the memory 72 can store a set of executable instructions including at least one user-selectable cycle of operation. Examples, without limitation, of treating cycles of operation include: wash, heavy-duty wash, delicate wash, quick wash, pre-wash, refresh, rinse only, and timed wash, which can be selected at the user interface 26. The memory 72 can also be used to store information, such as a database or table, and to store data received from the one or more components of the washing machine 10 that can be communicably coupled with the controller 70. The database or table can be used to store the various operating parameters for the one or more cycles of operation, including factory default values for the operating parameters and any adjustments to them by the control system or by user input.

The controller 70 can be operably coupled with one or more components of the washing machine 10 for communicating with and/or controlling the operation of the components to complete a cycle of operation. For example, the controller 70 can be coupled with the hot water valve 48, the cold water valve 50, the diverter valve 55, the spray arm assembly 100, and the dispenser 54 for controlling the temperature and flow rate of treating liquid into the treating chamber 32; the pump 62 for controlling the amount of treating liquid in the treating chamber 32 or sump 60; drive system 40 at the motor 41 for controlling the direction and speed of rotation of the basket 30 and/or the clothes mover 38; and the user interface 26 for receiving user selected inputs and communicating information to the user. The controller 70 can also receive input from a temperature sensor 76, such as a thermistor, which can detect the temperature of the treating liquid in the treating chamber 32 and/or the temperature of the treating liquid being supplied to the treating chamber 32. The controller 70 can also receive input from various additional sensors 78, which are known in the art and not shown for simplicity. Non-limiting examples of additional sensors 78 that can be communicably coupled with the controller 70 include a weight sensor, a moisture sensor, a chemical sensor, a position sensor, an imbalance sensor, a load size sensor, and a motor torque sensor, which can be used to determine a variety of system and laundry characteristics, such as laundry load inertia or mass.

Figure 3:
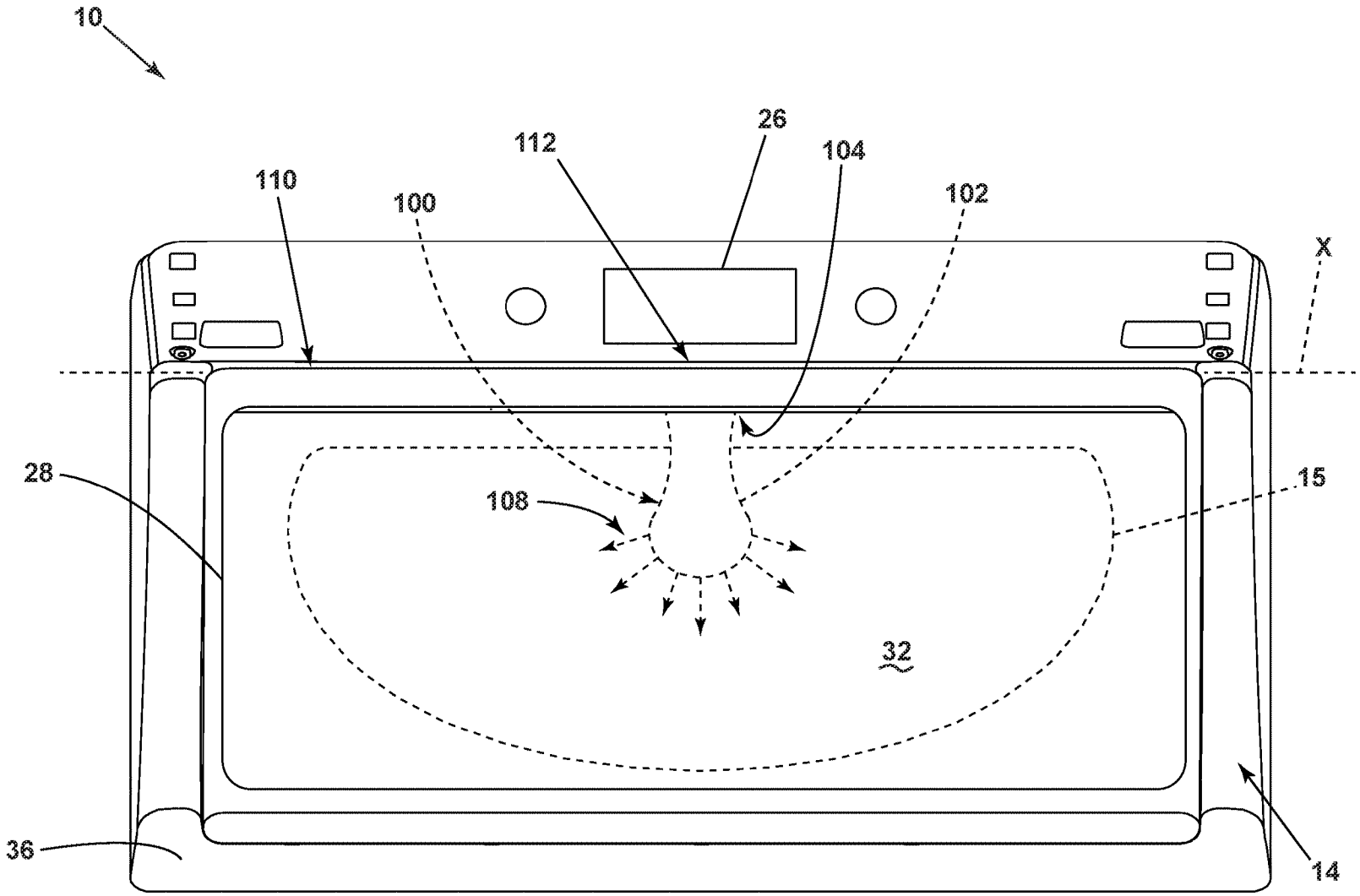
FIG. 3 is a top view of the laundry treating appliance of FIG. 1 with a cover in a closed position and the spray arm assembly in a lowered position.
Figure 4:
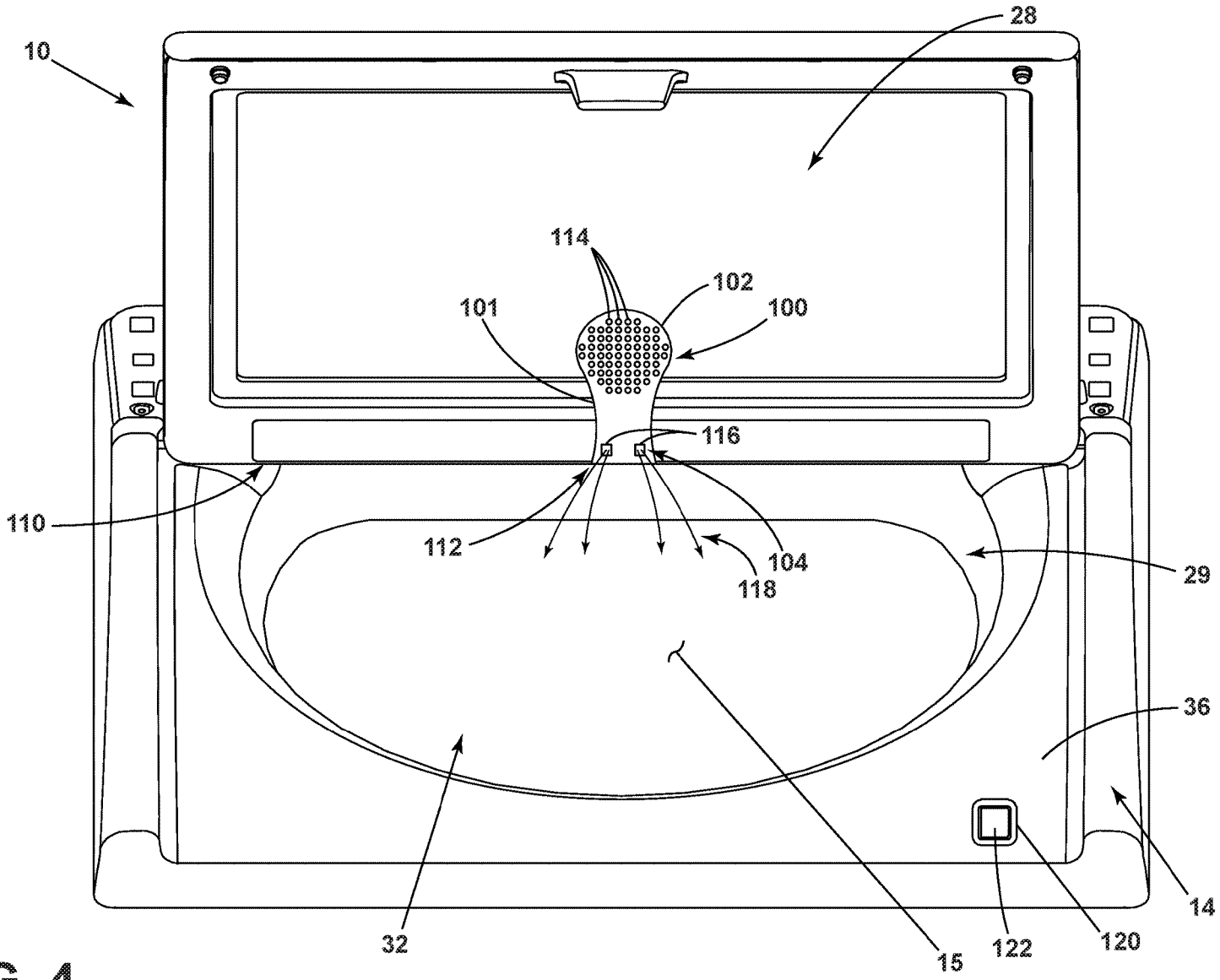
FIG. 4 is a top view of the laundry treating appliance of FIG. 3 with the cover in an opened position and the spray arm assembly in a raised position.

Turning now to FIG. 3, a top view of the washing machine 10 with the lid 28 in the closed position is illustrated and the spray arm assembly 100 can be seen. The lid 28 is rotatably and hingedly mounted to the cabinet 14 by a lid hinge 110. In one example, the lid hinge 110 can comprise two hinge pins provided at opposite ends of the lid 28, though it will be understood that other hinge configurations can be provided, non-limiting examples of which include at least one hinge provided at any suitable point on the lid 28, or a single hinge that spans the entire width of the lid 28. The lid 28 can rotate between the closed position and the opened position relative to the cabinet 14 about an axis of rotation X defined by the lid hinge 110. The spray arm assembly 100 can be provided underneath the lid 28 and can be coupled to the lid 28 such that when the lid 28 is moved between the closed position and the opened position, the spray arm assembly 100 is moved through a range of motion between a lowered position as seen and a raised position (FIG. 4). However, it will also be understood that the spray arm assembly 100 and the lid 28 can be rotated independently of one another, such that the spray arm assembly 100 can be moved throughout the range of motion between the raised and lowered positions even while the lid 28 remains in the opened position.

The spray arm assembly 100 can further include a spray arm hinge 112 about which the spray arm assembly 100 is rotatably movable. The spray arm hinge 112 can hingedly couple the spray arm assembly 100 to the first water conduit 56 and the spray arm valve 106. The axis of rotation of the spray arm hinge 112 can be coaxial with the axis of rotation X defined by the lid hinge 110. In one aspect, the spray arm hinge 112 can be at least partially coextensive with the lid hinge 110. It will be understood that various configurations for the spray arm hinge 112 and the lid hinge 110 are contemplated, such that the lid hinge 110 and the spray arm hinge 112 are rotatable about the coaxial axis of rotation X. By way of non-limiting example, the spray arm hinge 112 can be integral with the lid hinge 110, the spray arm hinge 112 can form at least part of the lid hinge 110, the spray arm hinge 112 can hingedly couple or mount the lid 28 to the cabinet 14, or the spray arm hinge 112 and the lid hinge 110 can be coaxial but can be not physically overlapping at any point. The lid hinge 110 can be a separate piece that is coupled to the lid 28, or the lid hinge 110 can be integrally formed with the lid 28. Likewise, the spray arm hinge 112 can be a separate piece that is coupled to the spray arm assembly 100, or the spray arm hinge 112 can be integrally formed with the spray arm assembly 100.

When the lid 28 is in the closed position, the spray arm assembly 100 is in the lowered position. When the spray arm assembly 100 is in the lowered position, the spray head 102 can overlie the access opening 15 of the treating chamber 32, and can further confront the access opening 15. In the lowered position, the spray head 102 can be configured to provide a liquid spray 108 to the treating chamber 32, such as for wetting laundry items within the treating chamber 32 or for aiding in the rinsing of laundry items. The spray arm valve 106 (FIG. 1) can be configured to selectively couple the spray head 102 with the first water conduit 56 when the spray arm assembly 100 is in the lowered position, such that liquid is supplied to the spray head 102 through the spray arm valve 106 when the lid 28 is in the closed position. In one aspect of the present disclosure, it is contemplated that liquid can be supplied to the spray head 102 only when the lid 28 is in the closed position and the spray arm assembly 100 is in the lowered position.

FIG. 4 illustrates a top view of the washing machine 10 with the lid 28 in the opened position and the spray arm assembly 100 in the raised position. The spray arm assembly comprises a spray arm body 101 that defines the spray head 102 and the faucet 104. The spray head 102 can further include a set of liquid outlets, illustrated herein as spray openings 114 through which the liquid spray 108 can be provided. As used herein, the term a set can be any suitable number of spray openings 114, including only a single spray opening 114. While the spray head 102 is illustrated herein as having a generally circular shape, it will be understood that any suitable shape can be used, including oval, square, rectangular, etc. While the spray arm assembly 100 is illustrated herein as a static spray arm assembly 100 similar to a showerhead, it will be understood that the spray arm assembly 100 can include other configurations, non-limiting examples of which include a rotary spray arm, a flexible spray wand, or a retractable spray wand.

The faucet 104 can further include at least one faucet opening 116 through which a liquid flow 118 can be emitted to the treating chamber 32 when the spray arm assembly 100 is in the raised position. While the at least one faucet opening 116 is illustrated herein as being provided at a lower portion of the spray arm body 101, adjacent the spray arm hinge 112, it will be understood that the at least one faucet opening 116 can be provided at any suitable location on the spray arm body 101, including just below and adjacent to the spray head 102 or that the faucet 104 can be integrated with the spray arm hinge 112. While the spray openings 114 and the at least one faucet opening 116 are illustrated herein as openings or outlets provided in the spray arm body 101, it will be understood that the spray openings 114 or the at least one faucet opening 116 can comprise any suitable spray manifold or nozzle structure for delivering liquid at a desired pressure, angle, or pattern.

When the lid 28 is in the opened position and the spray arm assembly 100 is in the raised position, the faucet 104 can be operable to emit the liquid flow 118 to the treating chamber 32. The spray arm valve 106 can be configured to selectively couple the faucet 104 with the first water conduit 56 when the spray arm assembly 100 is in the raised position, such that liquid is supplied to the faucet 104 through the spray arm valve 106 when the lid 28 is in the opened position. In one aspect of the present disclosure, it is contemplated that liquid can be supplied to the faucet 104 only when the lid 28 is in the opened position and the spray arm assembly 100 is in the raised position.

A user-actuated control, illustrated herein as an actuator 120 can operably couple to the spray arm assembly 100 to control the flow of liquid to the spray arm assembly 100 through the first water conduit 56. A user can operate the actuator 120 to utilize the spray arm assembly 100, such as for pre-treatment of laundry items or for adding wash liquid to the treating chamber 32. In one illustrative aspect, the actuator 120 can be provided in the form of a user-actuated switch 122. However, it will be understood that the actuator 120 can be any suitable actuatable element, non-limiting examples of which include a switch, button, dial, or knob. The actuator 120 can be a mechanical actuator wherein the supply of water is controlled by way of a mechanical operation, or the actuator 120 can be an electrical actuator wherein the supply of water is controlled by way of an electric signal or current. Alternatively, it is contemplated that any suitable operable user-actuated control mechanism can be used to control the supply of water to the spray arm assembly 100.

As illustrated herein, the actuator 120 can be provided on the top wall 36 of the cabinet 14 such that the lid 28 overlies the actuator 120 when the lid 28 is in the closed position. Alternately, the actuator 120 can be located on the shroud 29, such that the actuator 120 is accessible through the access opening 15 when the lid 28 is in the opened position. However, it will be understood that the actuator 120 can have any suitable location on the washing machine 10 that is accessible by a user, non-limiting examples of which include on the cabinet 14, lid 28, or user interface 26, whether or not the lid 28 overlies the actuator 120 in the closed or opened position, and whether or not the actuator 120 is adjacent to or spaced from the spray arm assembly 100.

Figure 5:
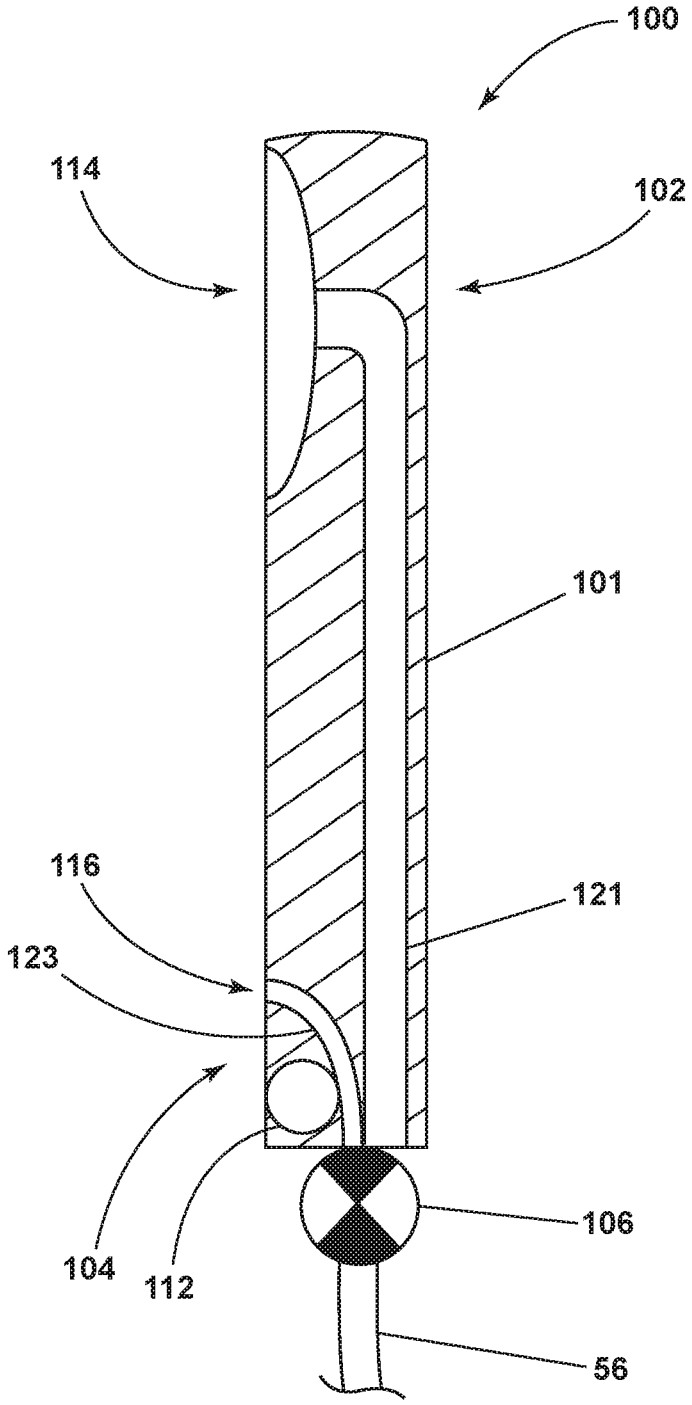
FIG. 5 is a side cross-sectional view of the spray arm assembly of FIG. 1.

FIG. 5 illustrates a schematic cross-sectional view of the spray arm assembly 100 and the spray arm valve 106. The spray arm body 101 can further define a spray head conduit 121 and a faucet conduit 123. The spray head conduit 121 and the faucet conduit 123 can selectively couple with the spray arm valve 106 to selectively provide water to either the spray head 102 or the faucet 104. Specifically, the spray head conduit 121 can selectively fluidly couple the spray arm valve 106 with the spray openings 114 while the faucet conduit 123 can selectively fluidly couple the spray arm valve 106 with the at least one faucet opening 116. In one example, the spray arm valve 106 can be fluidly coupled with the spray head conduit 121 when the spray arm assembly 100 is in the lowered position, while the spray arm valve 106 is fluidly coupled with the faucet conduit 123 when the spray arm assembly 100 is in the raised position.

Either or both of the spray head conduit 121 and the faucet conduit 123 can be or can include flexible or extendable portions so as to maintain their selective coupling with the spray arm valve 106 as the spray arm assembly 100 moves between the lowered and the raised positions. While the faucet conduit 123 is illustrated herein as passing around the spray arm hinge 112 to couple with the faucet opening 116 that are provided above the spray arm hinge 112, it will be understood that the faucet openings 116 can be provided within the spray arm hinge 112, such that the faucet conduit 123 passes through, and can be integral with or defined by, the spray arm hinge 112. Further, in one example, the spray arm hinge 112 can be configured to allow liquid or either or both of the spray head conduit 121 or the faucet conduit 123 to pass through the spray arm hinge 112 to provide liquid to the spray arm assembly 100.

In one aspect of the present disclosure, the spray arm valve 106 can be mechanically actuated such that the spray arm valve 106 is actuated by the position of the lid 28 in the closed position or the opened position, or by the movement of the lid 28 between the closed position and the opened position. When the spray arm valve 106 is mechanically actuated based on the opened position or the closed position of the lid 28, it will be understood that liquid can be supplied to the faucet 104 only when the lid 28 is in the opened position and that liquid can be supplied to the spray head 102 only when the lid 28 is in the closed position. In this aspect, the actuator 120 can control whether or not water is supplied to the spray arm assembly 100 through the first water conduit 56 while the spray arm valve 106 can control whether the water supplied to the spray arm assembly 100 is supplied to the faucet 104 or to the spray head 102 based on the opened or closed position of the lid 28 and the lowered or raised position of the spray arm assembly 100.

In another aspect of the present disclosure, the spray arm valve 106 can be operably coupled to the actuator 120 such that the spray arm valve 106 can be mechanically or electrically actuated under control of the actuator 120 to selectively provide water from the first water conduit 56 to either the spray head 102 or the faucet 104, rather than the spray arm valve 106 being actuated by the movement of the lid 28. When the spray arm valve 106 is actuated based on control from the actuator 120, it will be understood that liquid can be supplied to either of the faucet 104 or the spray head 102 when the lid 28 is in the opened or the closed position. In this aspect, the actuator 120 can control not only whether or not water is supplied to the spray arm assembly 100 through the first water conduit 56, but also whether water supplied to the spray arm valve 106 is provided to the faucet 104 or to the spray head 102 based on a user selection or user actuation. In such an aspect, the actuator 120 can comprise at least two switches 122, rather than a single switch 122, such that one switch 122 can control whether or not the spray arm assembly 100 is operating, while the second switch 122 can control the provision of water to either the faucet 104 or the spray head 102.

Figure 6:
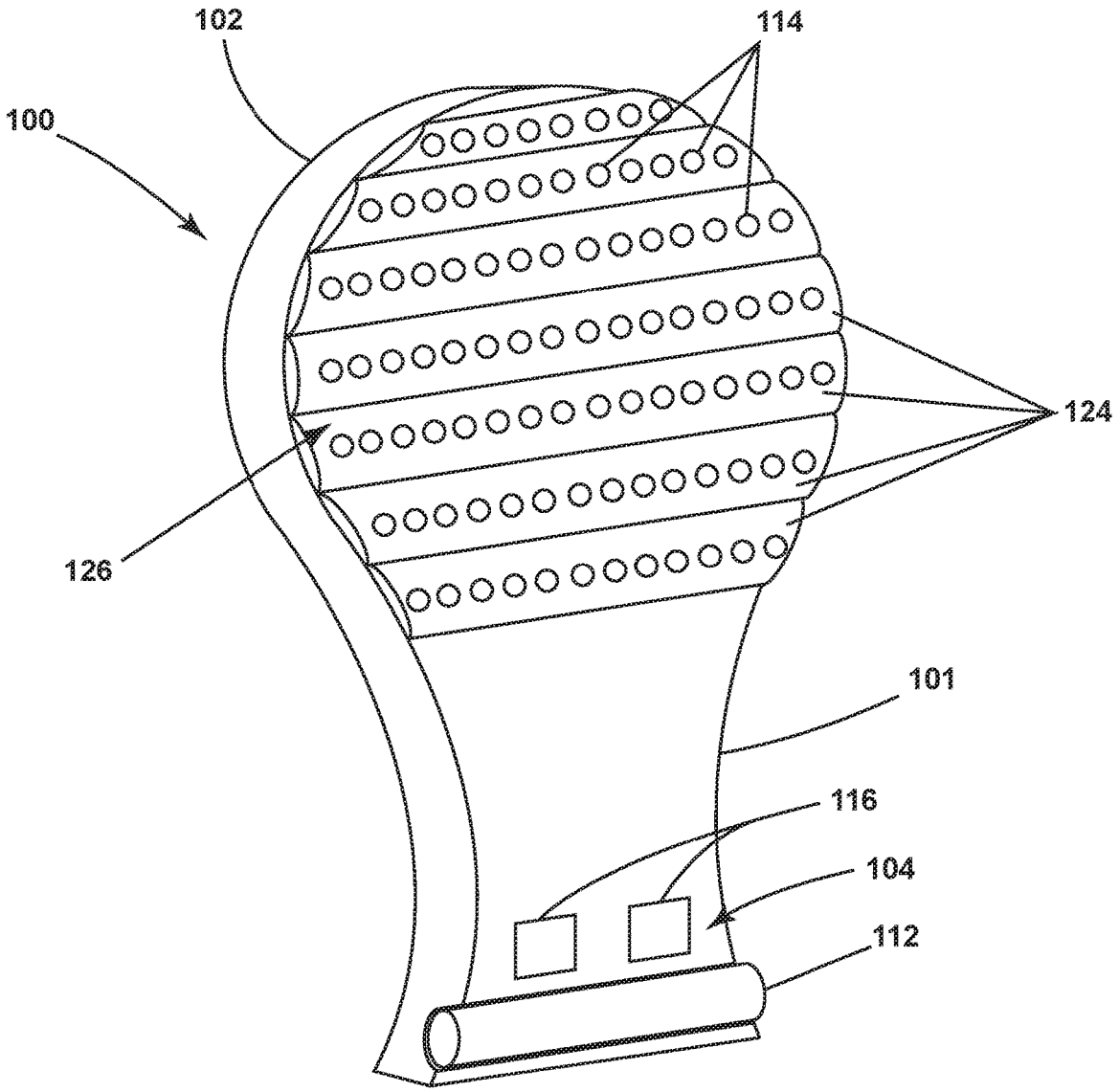
FIG. 6 is a perspective view of the spray arm assembly having a scrub surface.

FIG. 6 illustrates a perspective view of the spray arm assembly 100 according to another aspect of the present disclosure. In this aspect, the spray head 102 can include a scrub surface 126. The scrub surface 126 can comprise a plurality of corrugations 124 defined by the spray head 102. While the corrugations 124 are illustrated herein as being parallel to and adjacent one another, it will be understood that the corrugations 124 can be spaced apart from one another and provided in any desired configuration relative to one another. The spray openings 114 can be provided on or within the corrugations 124 as illustrated, or the spray openings 114 can be provided, by way of non-limiting example, between the corrugations 124 or at any suitable location within the scrub surface 126. Further, while the scrub surface 126 is illustrated herein as comprising corrugations 124, it will be understand that any suitable geometry can be provided to provide a texture or topography for the scrub surface 126, non-limiting examples of which include ridges, ribs, a washboard configuration, nubs, grooves, or bristles.

The scrub surface 126 can be accessible by a user to be used for scrubbing laundry items to be pre-treated when the spray arm assembly 100 is in the raised position and the lid is in the closed position. When the spray arm assembly 100 is in the lowered position and the lid is in the closed position, the scrub surface 126 can confront the access opening 15. It is also contemplated that the spray arm assembly 100, and specifically the spray arm body 101 can further include a pivot point such that at least a portion of the spray arm assembly 100 can be rotated such that the scrub surface 126 can face upwardly towards a user when desired, even when the spray arm assembly 100 is in the lowered position.

In another aspect of the present disclosure, the spray arm assembly 100 can be fluidly coupled to the treating chemistry dispenser 54 such that a treating chemistry, in addition to water, can be provided through the spray arm assembly 100, including through spray openings 114 and the scrub surface 126, and even during use of the scrub surface 126, to further aid in the pre-treating or stain treating of laundry items. The provision of a treating chemistry through the spray arm assembly 100 can also be under user-actuated control by the actuator 120. Alternately, a user can separately provide a treating chemistry to a laundry item to be treated with the scrub surface 126, either before or after using the faucet 104 or spray head 102 to wet the laundry item to be pre-treated.

Figure 7:
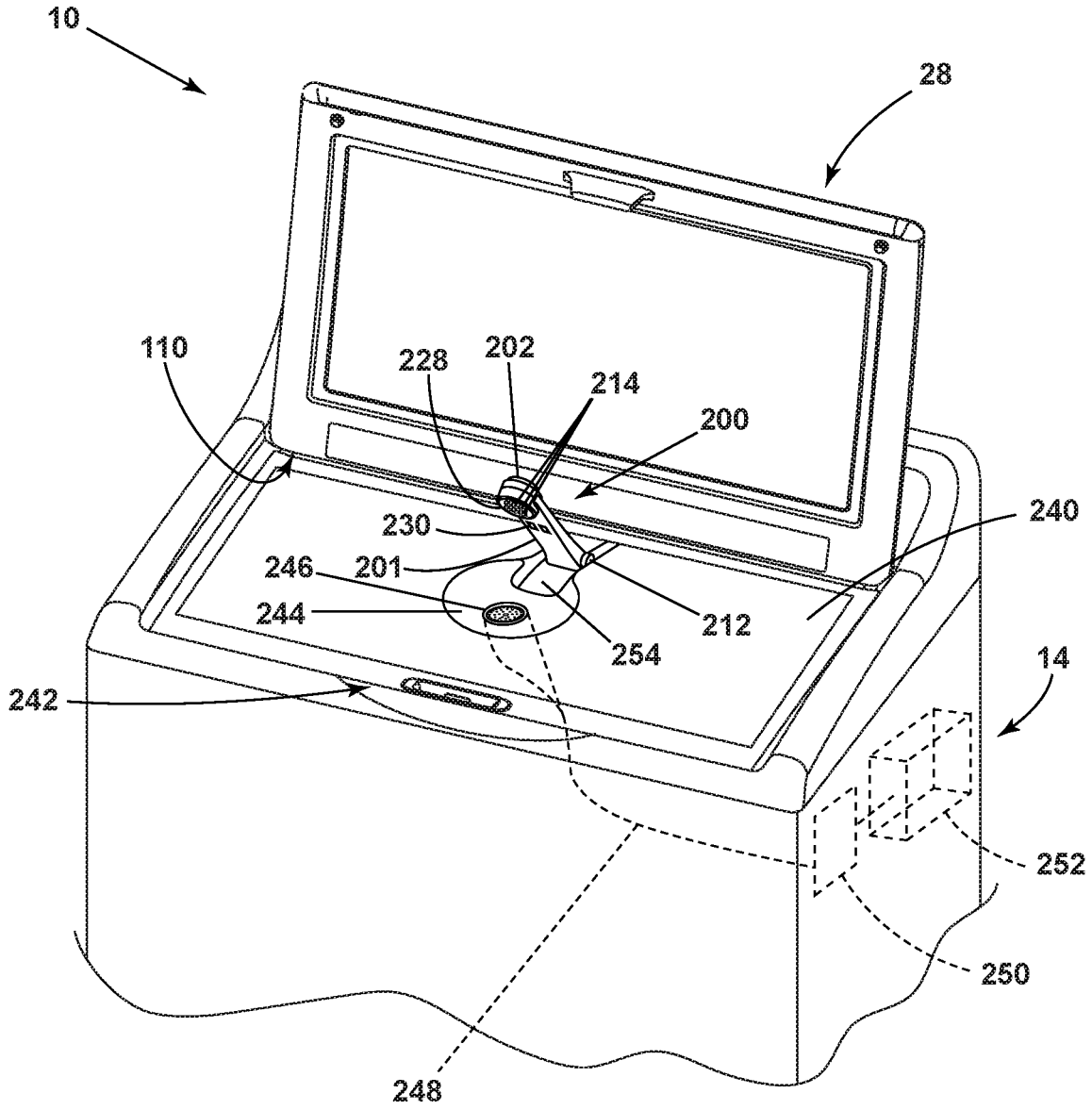
FIG. 7 is a perspective view of the laundry treating appliance of FIG. 1 with another example of a spray arm assembly, provided in a raised position, and including a basin.

FIG. 7 illustrates a top perspective view of the washing machine 10 having another example of a spray arm assembly 200 provided in a raised position. In this example, the spray arm assembly 200 comprises a spray arm body 201 defining a spray head 202. In this example, and as illustrated herein, the spray arm assembly 200 may not include the faucet 104 as provided with the initially discussed spray arm assembly 100. Rather, when liquid is selectively provided to the spray arm assembly 200, the liquid flows through the spray head 202. The spray arm body 201 can further include at least one lighting element 230. The at least one lighting element 230 can be any suitable light source to illuminate a laundry item to be treated, non-limiting examples of which include an LED, an LED array, or other light bulb.

The spray head 202 can further comprise a scrubbing surface 228 defining a set of liquid outlets, illustrated herein as spray openings 214 through which a liquid spray can be provided. The liquid spray delivered through the spray openings 214 can also include a treating chemistry, a mixture of water and a treating chemistry, or steam, by way of non-limiting example. As used herein, the term a set can be any suitable number of spray openings 214, including only a single spray opening 214. The scrubbing surface 228 can provide a textured area for treating laundry items to be pre-treating. By way of non-limiting example, the scrubbing surface 228 can define bristles or nubs for pre-treating of laundry items. In one example, the scrubbing surface 228 can be rotatable within the spray head 202 to provide a spinning or back-and-forth motion to further aid in pre-treating of stained laundry items. Such rotation of the scrubbing surface 228 can be manually operated by the user or can be electronically controlled by the controller 70. While the spray head 202 is illustrated herein as having a generally circular shape, it will be understood that any suitable shape can be used, including oval, square, rectangular, etc. While the spray arm assembly 200 is illustrated herein as a static spray arm assembly 200 similar to a showerhead, it will be understood that the spray arm assembly 200 can include other configurations, non-limiting examples of which include a rotary spray arm, a flexible spray wand, or a retractable spray wand.

The spray arm assembly 200 can further comprise a spray arm hinge 212 that may be parallel to and spaced from the lid hinge 110, rather than being coaxial with the lid hinge 110, such that the spray arm assembly 200 can pivot about the spray arm hinge 212 independently of the lid 28 pivoting about the lid hinge 110. Specifically, when the lid 28 is in the opened position, the spray arm assembly 200 can be moved between the raised and lowered positions. In one example, the spray arm assembly 200 can be moved between the raised and lowered positions by a user and can be held in either the raised or lowered position by, in non-limiting example, a friction mechanism, a snap fit, a push-push release, or a detented mechanism.

A secondary lid 240 can be provided below the spray arm assembly 200 and above or overlying the access opening 15 of the treating chamber 32. The secondary lid 240 can also be pivotably or hingedly coupled to the cabinet 14, and can have an axis of rotation coaxial with the axis of rotation of the lid 28. In one example, the spray arm assembly 200 can be coupled to and can extend from the secondary lid 240, hingedly coupled to the secondary lid 240 via the spray arm hinge 212. A recess 242 can be provided in the cabinet 14 to allow a user to grip the edge of the secondary lid 240 in order to rotate the secondary lid 240 upward to allow access to the access opening 15 and treating chamber 32. The secondary lid 240 can comprise a basin 244 defining a drain 246. The spray arm assembly 200 can be positioned such that it overlies the basin 244. Specifically, the spray head 202 can overlie the basin 244 and the drain 246. In one example, the basin 244 can have a depth of two to three inches, though it will be understood that the basin 244 can have any suitable depth for the pre-treating of laundry items.

A drain conduit 248 can be provided beneath the drain 246 and beneath the secondary lid 240 and can fluidly couple the basin 244 and the drain 246 to a gray water reservoir 252 provided within the cabinet 14. The gray water reservoir 252 can hold the liquid drained from the basin 244 until a specific point or cycle of operation at which the liquid from the gray water reservoir 252 can be safely drained to the sump 60 without contacting a clean laundry load. The basin 244 can further include an overflow 254 that can be fluidly coupled to either the drain conduit 248 or to a secondary drain (not shown) which can serve to drain away liquid that may overflow from the basin 244. A suction source 250 can be coupled to the drain conduit 248 to assist in draining of fluid from the basin 244 to the gray water reservoir 252. The inclusion of the suction source 250, in addition to improving draining of fluid from the basin 244 to the gray water reservoir 252 over gravity alone, can also result in improved stain pre-treating performance as the vacuum or suction generated by the suction source 250 can also serve to pull treating chemistry, liquid, and/or steam through the laundry item to be pre-treated.

Alternately, or in addition, the drain 246 can be fluidly coupled to the treating chamber 32 to allow liquid from the basin 244 to flow through the drain 246 into the treating chamber 32 as the drain 246 can overlie the access opening 15 of the treating chamber 32. In one example, liquid from the basin 244 can be selectively drained either to the treating chamber 32 or to the gray water reservoir 252. In the case that the drain 246 is fluidly coupled with the treating chamber 32, the spray arm assembly 200 can serve as an additional liquid source for providing liquid to the treating chamber 32 for a cycle of operation. In yet another example, the drain 246 can be in direct fluid communication with the sump 60.

Figure 8:
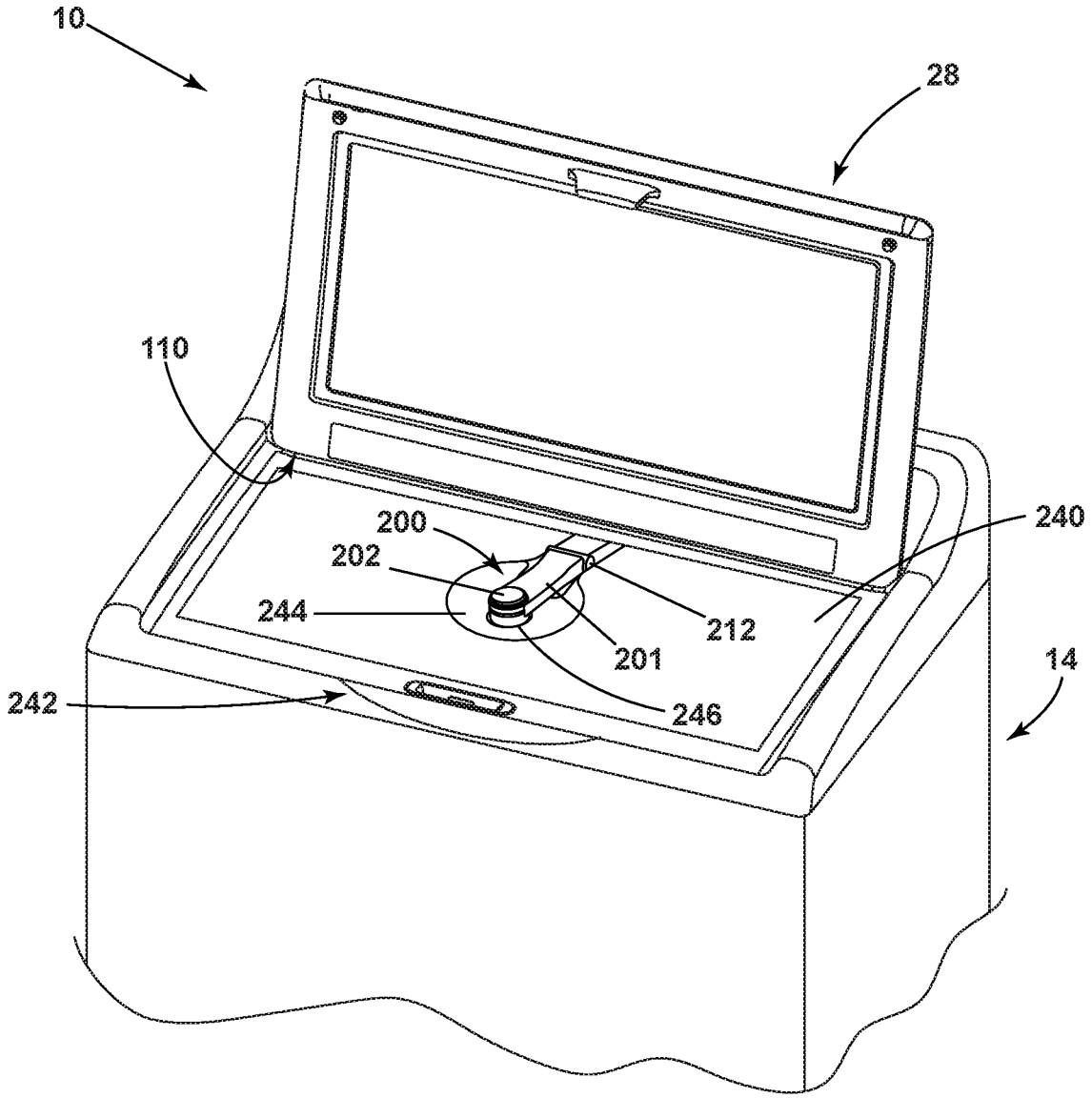
FIG. 8 is a perspective view of the spray arm assembly of FIG. 7 with the spray arm assembled in a lowered position.

FIG. 8 illustrates the spray arm assembly 200 in the lowered position relative to the lid 28 and the secondary lid 240. While the spray arm assembly 200, and specifically the spray head 202, can be configured to emit liquid in either the raised or the lowered position, it is contemplated that the lowered position of the spray arm assembly 200 can be the treating position for pre-treating laundry items. In this case, the user can place a laundry item to be pre-treated within the basin 244. The spray arm assembly 200 can be moved to the lowered position to emit water, treating chemistry, or a combination of water and treating chemistry onto the laundry item via the spray head 202. Should additional agitation of the stained area be desired, the user can then bring the laundry item upwardly against the spray head 202, and specifically against the scrubbing surface 228 for additional scrubbing action. Optionally, rotational movement of the scrubbing surface 228 relative to the spray head 202 can provide yet further scrubbing action to the laundry item to be pre-treated.

Figure 9:
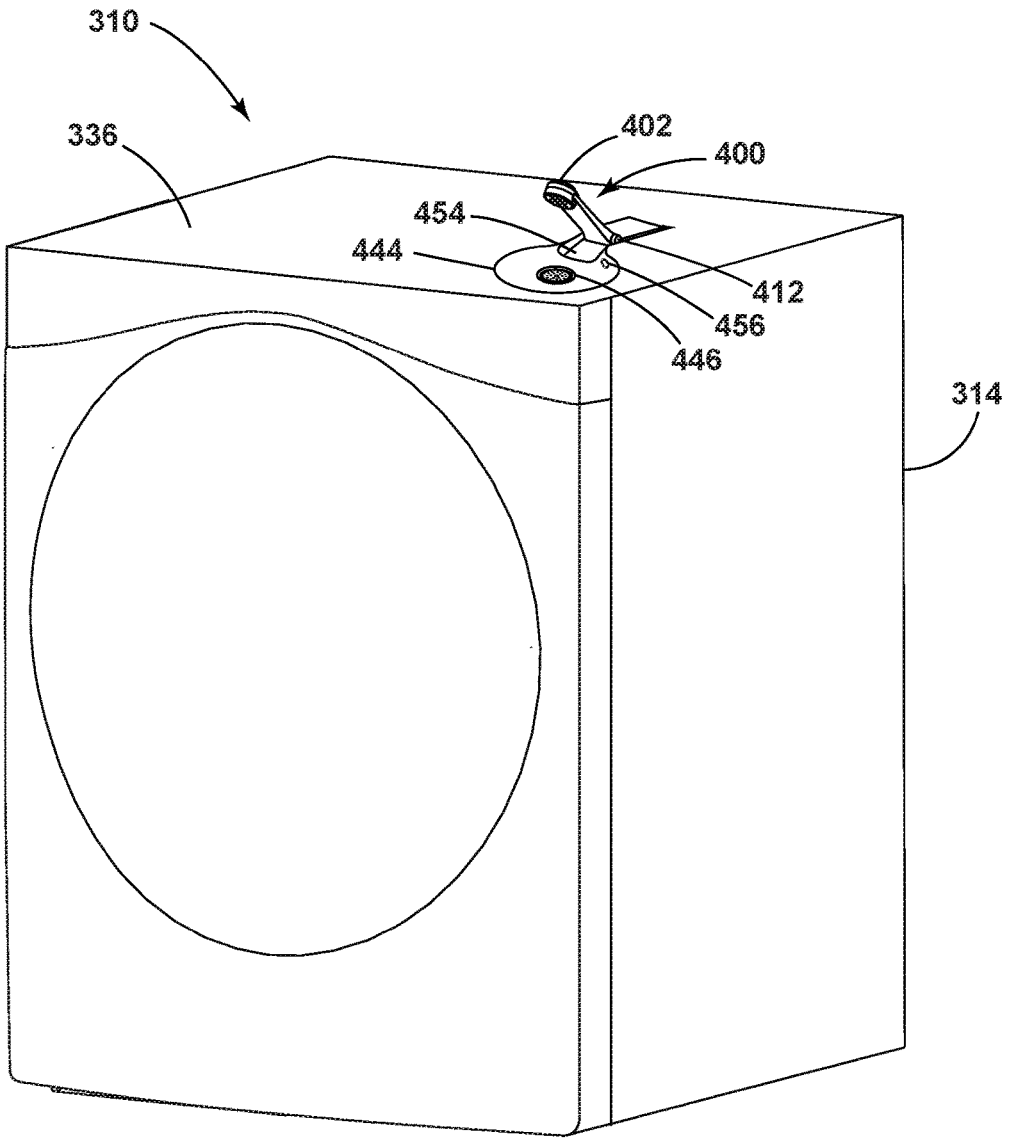
FIG. 9 is a perspective view of another example of a laundry treating appliance including a spray arm assembly.

FIG. 9 illustrates yet another example of a spray arm assembly 400 in the raised position. The spray arm assembly 400, as well as a basin 444 having an overflow 454 and a drain 446, can be identical to that of the spray arm assembly 200 described in FIGS. 7-8, except that it is provided within a cabinet 314, and specifically within a top wall 336 of the cabinet 314, of a horizontal axis washing machine 310, rather than the vertical axis washing machine 10 of the previous examples. The basin 444 can be removably coupled to the cabinet 314 for improved serviceability. While the basin 444 and the spray arm assembly 400 are illustrated herein as being provided at a front corner of the top wall 336, it will be understood that the basin 444 and spray arm assembly 400 can be provided at any suitable position within the top wall 336 for convenient user access.

In this case, where the spray arm assembly 400 is provided within the top wall 336 of the cabinet 314, it is contemplated that the spray arm assembly 400 can be provided in the lowered position about a spray arm hinge 412 during shipping of the washing machine 310, such that the spray arm assembly 400 is flush with or slightly below the top wall 336, and can even be locked into the lowered position during shipping.

The basin 444 can further comprise a liquid inlet 456 in addition to the spray head 402 of the spray arm assembly 400. The liquid inlet 456 can be positioned and provided at an angle in order to ensure that liquid flowing into the basin 444 from the liquid inlet 456 follows a circular flow path within the basin 444 to reduce splashing. In the previous example, the basin 244 was provided within the secondary lid 240 and overlying the access opening 15 of the treating chamber 32, such that liquid that may splash out of the basin 244 would not be a nuisance to the user and can be easily cleaned. In the current example, the basin 444 is provided instead in the top wall 336 of the cabinet 314, not overlying an access opening, so liquid splashing outside of the basin 444 may be a nuisance to the user. To address this, the liquid inlet 456 provided within the basin 444 can allow liquid to be provided to the basin 444 in a manner that will result in reduced splashing compared to providing liquid from the spray head 402 when the spray arm assembly 400 is in the raised position.

The spray arm assemblies obviate the need for an external sink or space for pre-washing or pre-treating laundry. The spray arm assemblies can enable a user to pre-treat laundry items prior to running a cycle of operation, while containing any liquid or treating chemistry within the washing machine. The spray arm assemblies can also minimize or eliminate additional space otherwise required to route the supply of water to the treating chamber. In addition to the features illustrated and described herein, a variety of additional elements can be provided with the spray arm assemblies in any suitable combination. A basin extender can be provided to surround and extend upwardly from the periphery of the basin and further reduce splashing and provide a surface for design accents, or a scrub board or washboard can be provided to overlay the basin. Control features can be provided to ensure that the spray arm assemblies and/or the drains can operate only during certain cycles of operation or only for a predetermined length of time to avoid overwhelming the drains. Float sensors can be provided and operably coupled with at least one of the treating chamber and the basin to monitor respective liquid levels and prevent undesired mixing of the contents or overflow. A flushing process or cycle of operation can also be provided for in order to rinse the basin, which allows for non-traditional uses of the basin, such as brushing of teeth, while still maintaining a clean basin.

The aspects of the present disclosure provide for spray arm assemblies that provide flexibility to a user for pre-treating laundry items by providing a water supply, optional treating chemistry, a watertight container to obviate a separate sink basin, and a work surface for pre-treating all provided by the single assembly within the washing machine. By providing a scrub surface with the spray arm assembly, the spray arm assembly serves as a pre-treatment faucet as well as a surface for scrubbing of a stained laundry item that allows a user 360° access to the scrubbing surface. The operation of the spray arm assembly can be easily actuated by movement of the lid, or can be under user control for optimal user experience. By providing a water inlet to the treating chamber that can spray from the lid rather than from the shroud or other location, and by providing a spray head configuration rather than a single stream of liquid, better wetting coverage of laundry items can be achieved.

To the extent not already described, the different features and structures of the various aspects can be used in combination with each other as desired. That one feature may not be illustrated in all of the aspects of the disclosure is not meant to be construed that it cannot be, but is done for brevity of description. Thus, the various features of the different aspects can be mixed and matched as desired to form new aspects, whether or not the new aspects are expressly described. All combinations or permutations of features described herein are covered by this disclosure.

While the present disclosure has been specifically described in connection with certain specific aspects thereof, it is to be understood that this is by way of illustration and not of limitation. Reasonable variation and modification are possible within the scope of the forgoing disclosure and drawings without departing from the spirit of the present disclosure which is defined in the appended claims. Hence, specific dimensions and other physical characteristics relating to the aspects of the present disclosure are not to be considered as limiting, unless expressly stated otherwise.

What is claimed is:

1. A laundry treating appliance comprising:

a chassis defining an interior;

a rotatable treating chamber located within the interior and having an access opening;

a cover movably mounted to the chassis for selective movement between opened/closed positions to open/close the access opening; and a spray arm assembly is coupled to the cover such that when the cover is moved between the opened/closed positions, the spray arm assembly is moved through a range of motion between raised/lowered positions, the spray arm assembly having a spray head and a faucet, with the spray head overlying the access opening when the spray arm assembly is in the lowered position to spray liquid into the treating chamber, and the faucet operable to emit liquid into the treating chamber when the spray arm assembly is in the raised position.

2. The laundry treating appliance of claim 1 wherein the spray arm assembly comprises a spray arm hinge and the faucet is integrated with the spray arm hinge.

3. The laundry treating appliance of claim 2 wherein the cover comprises a lid and a lid hinge that hingedly mounts the lid to the chassis.

4. The laundry treating appliance of claim 3 wherein the lid hinge and the spray arm hinge have coaxial axes of rotation.

5. The laundry treating appliance of claim 3 wherein the spray arm hinge hingedly mounts the lid to the chassis.

6. The laundry treating appliance of claim 5 wherein the spray arm hinge forms at least part of the lid hinge.

7. The laundry treating appliance of claim 1 wherein the spray arm assembly further comprises a valve controlling liquid flow to the spray head and the faucet.

8. The laundry treating appliance of claim 7 wherein the valve is actuated based on the raised/lowered position of the spray arm assembly.

9. The laundry treating appliance of claim 8 wherein the valve supplies liquid to the faucet when the spray arm assembly is raised and to the spray head when the spray arm assembly is lowered.

10. The laundry treating appliance of claim 8 wherein the valve only supplies liquid to the faucet when the spray arm assembly is raised and only supplies liquid to the spray head when the spray arm assembly is lowered.

11. The laundry treating appliance of claim 7 further comprising a user-actuated control operably coupled to the valve to control the flow of liquid to the spray head or the faucet.

12. The laundry treating appliance of claim 11 wherein the user-actuated control is located on the chassis.

13. The laundry treating appliance of claim 12 wherein the chassis comprises a shroud at least partially encircling the access opening and the user-actuated control is located on the shroud.

14. The laundry treating appliance of claim 13 wherein the cover overlies the user-actuated control when closed.

15. The laundry treating appliance of claim 1 wherein the spray head includes a scrub surface.

16. The laundry treating appliance of claim 15 wherein the spray head comprises liquid outlets in the scrub surface.

17. The laundry treating appliance of claim 15 wherein the scrub surface confronts the access opening when the cover is closed.

18. The laundry treating appliance of claim 1, wherein when the cover is in the opened position, the spray arm assembly is in the raised position.

19. The laundry treating appliance of claim 1, wherein when the cover is in the closed position, the spray arm assembly is in the lowered position.

* * * * *